US006972779B2

(12) United States Patent
Motai et al.

(10) Patent No.: US 6,972,779 B2
(45) Date of Patent: Dec. 6, 2005

(54) FLAT-PANEL DISPLAY DEVICE

(75) Inventors: Tomonobu Motai, Yokohama (JP); Yoshiro Aoki, Kitamoto (JP); Kazuo Nakamura, Kitamoto (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 326 days.

(21) Appl. No.: 10/259,499

(22) Filed: Sep. 30, 2002

(65) Prior Publication Data

US 2003/0063109 A1 Apr. 3, 2003

(30) Foreign Application Priority Data

Sep. 29, 2001 (JP) ..... 2001-375004

(51) Int. Cl.[7] ..... G09G 5/10

(52) U.S. Cl. ..... 345/690; 345/205; 345/98

(58) Field of Search ..... 345/87–90, 690, 345/691, 694, 98–100, 205, 206

(56) References Cited

U.S. PATENT DOCUMENTS

| | | | | |
|---|---|---|---|---|
| 5,945,972 | A * | 8/1999 | Okumura et al. | 345/98 |
| 6,016,133 | A * | 1/2000 | Nito et al. | 345/89 |
| 6,266,038 | B1 * | 7/2001 | Yoshida et al. | 345/92 |
| 6,703,991 | B2 * | 3/2004 | Salters et al. | 345/63 |

FOREIGN PATENT DOCUMENTS

| | | |
|---|---|---|
| JP | 10-74064 | 3/1998 |
| JP | 11-202290 | 7/1999 |

* cited by examiner

*Primary Examiner*—Ricardo Osorio
*Assistant Examiner*—Tom Sheng
(74) *Attorney, Agent, or Firm*—Oblon, Spivak, McClelland, Maier & Neustadt, P.C.

(57) ABSTRACT

A liquid crystal display device comprises a plurality of display pixels PX each including sub-pixels weighted in a preset area ratio and a driving circuit which drives the display pixels. Particularly, the driving circuit is configured to determine the gradation of each display pixel PX by selectively combining the sub-pixels with driving periods weighted in a preset time ratio.

8 Claims, 6 Drawing Sheets

| | | PWM pulse width | | | | | | |
|---|---|---|---|---|---|---|---|---|
| | | 1 | 2 | 3 | 4 | 5 | 6 | 7 |
| Area-dependent gradation | 1 | 0.007 | 0.014 | 0.020 | ● 0.027 | ● 0.034 | 0.041 | 0.048 |
| | 4 | ● 0.027 | 0.054 | 0.082 | ● 0.109 | ● 0.136 | 0.163 | 0.190 |
| | 5 | ● 0.034 | 0.068 | 0.102 | ● 0.136 | 0.170 | 0.204 | 0.238 |
| | 16 | ● 0.109 | 0.218 | 0.327 | 0.435 | ● 0.544 | 0.653 | 0.762 |
| | 17 | 0.116 | 0.231 | 0.347 | 0.463 | 0.578 | 0.694 | 0.810 |
| | 20 | ● 0.136 | 0.272 | 0.408 | ● 0.544 | 0.680 | 0.816 | 0.952 |
| | 21 | 0.143 | 0.286 | 0.429 | 0.571 | 0.714 | 0.857 | 1.000 |

FLAT-PANEL DISPLAY DEVICE

CROSS-REFERENCE TO RELATED APPLICATIONS

This application is based upon and claims the benefit of priority from the prior Japanese Patent Application No. 2001-375004, filed Sep. 29, 2001, the entire contents of which are incorporated herein by reference.

BACKGROUND OF THE INVENTION

1. Field of the Invention

This invention relates to a flat-panel display device having an array of display pixels forming a display screen and more particularly to a flat-panel display device in which each display pixel is divided into a plurality of sub-pixels for multi-gradation display.

2. Description of the Related Art

Flat-panel display devices which are represented by liquid crystal display devices are widely used in personal computers, TV, game machines, etc., because of their characteristics of thinness, lightness, and low power consumption.

For example, a typical liquid crystal display device includes a plurality of display pixels arrayed in a matrix form, a plurality of scanning lines disposed along rows of the display pixels, a plurality of signal lines disposed along columns of the display pixels, and a plurality of pixel switches which are disposed in positions near the intersections of the signal lines and the scanning lines and each of which causes a video signal to be supplied to a corresponding one of the display pixels via a corresponding signal line when it is driven via a corresponding scanning line. Each display pixel includes a pixel electrode, a counter electrode and a liquid crystal layer held between the above electrodes as a display element and sets the light transmittance of the liquid crystal layer according to potential difference between the pixel electrode and the counter electrode which depends on the video signal.

Recently, a liquid crystal display device containing a one-bit static memory in each display pixel to attain low power consumption is put into practice, but with this structure, the display device can only display a monotone image such as a white or black image and cannot display a multi-gradation image.

Therefore, a study is made to display a multi-gradation image by dividing each display pixel into a plurality of sub-pixels, which are weighted according to a preset area ratio and providing memories in the respective sub-pixels.

For example, if it is desired to attain display of 32 gradations by use of five bits, it is necessary to divide the display pixel into sub-pixels weighted in an area ratio of 1:2:4:8:16. However, in this case, the minimum sub-pixel becomes several $\mu$m square and the layout thereof is extremely difficult when taking the accuracy of the producing process into consideration.

BRIEF SUMMARY OF THE INVENTION

The present invention has been made in order to solve the above technical problem and an object of the present invention is to provide a flat-panel display device which can attain a desired number of gradations with a reduced number of sub-pixels.

An aspect of the invention, there is provided a flat-panel display device which comprises a plurality of display pixels each including sub-pixels weighted in a preset area ratio, and a driving circuit which drives the display pixels, wherein the driving circuit is configured to determine a gradation of each display pixel by selectively combining the sub-pixels with driving periods weighted in a preset time ratio.

In the flat-panel display device, the sub-pixels weighted in a preset area ratio and the driving periods weighted in a preset time ratio are selectively combined to determine a gradation of each display pixel. In this case, since each display pixel has gradations depending on the product of the number of sub-pixels and the number of driving periods, the number of sub-pixels required for attaining a desired number of gradations can be reduced. As a result, the area of the smallest sub-pixel can be made large to remove restrictions due to the accuracy of the producing process.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

There will now be described a liquid crystal display device according to one embodiment of this invention with reference to the accompanying drawings.

Figure 1:
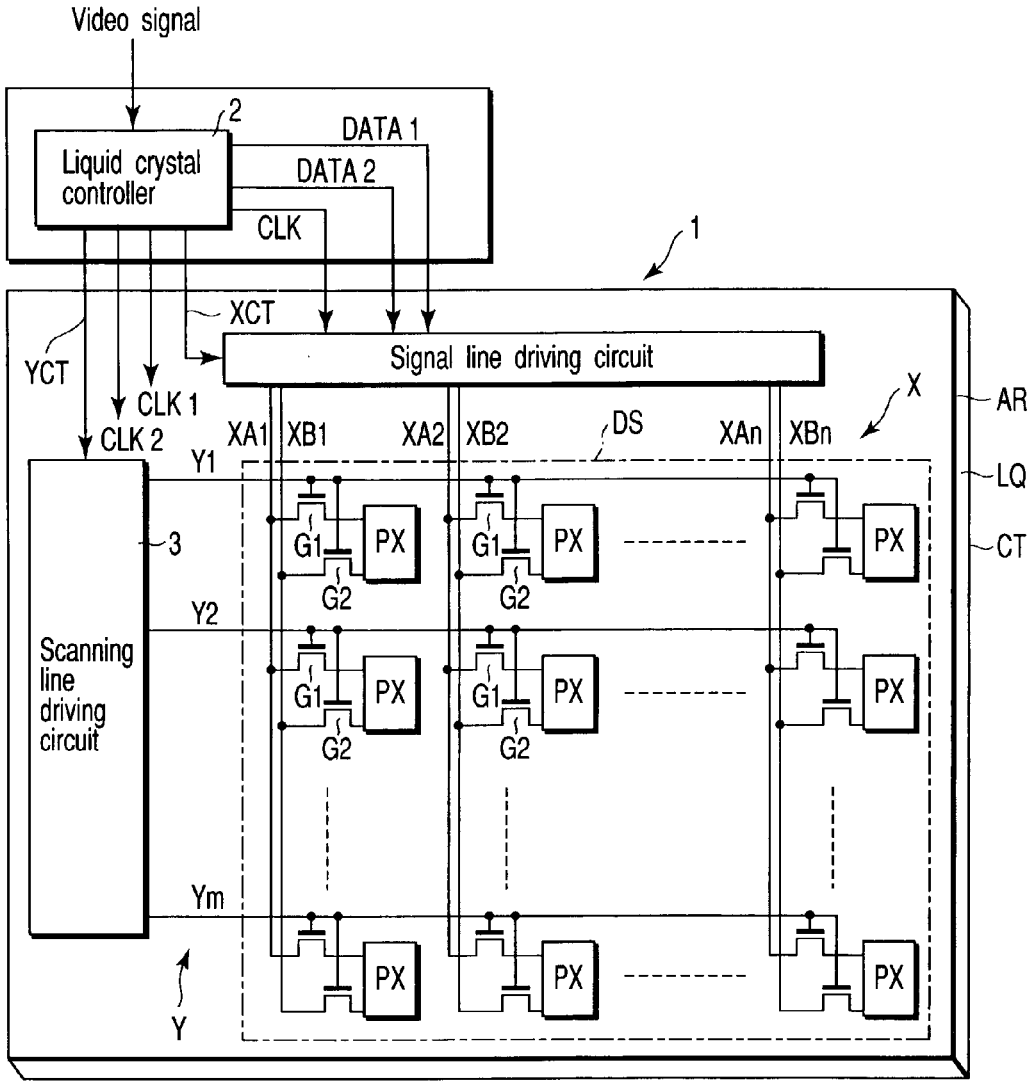
FIG. 1 is a diagram showing the schematic configuration of a liquid crystal display device according to one embodiment of this invention.

FIG. 1 shows the schematic configuration of the liquid crystal display device. The liquid crystal display device includes a liquid crystal display panel 1 and a liquid crystal controller 2 which controls the liquid crystal display panel 1. For example, the liquid crystal display panel 1 has a structure in which a liquid crystal layer LQ is held between an array substrate AR and a counter substrate CT, and the liquid crystal controller 2 is arranged on a driving circuit board which is independent from the liquid crystal display panel 1.

The liquid crystal display panel 1 comprises a plurality of display pixels PX arranged in a matrix form to configure a display screen DS, a plurality of scanning lines Y (Y1 to Ym) disposed along rows of the display pixels PX, a plurality of signal line pairs X (XA1, XB1 to XAn, XBn) disposed along columns of the display pixels PX, and a plurality of pixel switching sections disposed near the intersections of the signal lines X and scanning lines Y. Each of the pixel switching sections includes a pair of pixel switches G1 and G2 which electrically connect corresponding paired signal lines X to a corresponding one of the display pixels PX when the paired pixel switches G1 and G2 are driven via a corresponding scanning line Y. The liquid crystal display panel 1 additionally comprises a scanning line driving circuit 3 which drives the scanning lines Y1 to Ym and a signal line driving circuit 4 which drives the paired signal lines XA1, XB1 to XAn, XBn. Each display pixel PX is a display element formed of a pixel electrode formed on the array substrate AR, a counter electrode formed on the counter substrate CT and a liquid crystal layer LQ located between the pixel and counter electrodes to set the light transmittance of the liquid crystal layer according to a difference between the potentials of the pixel electrode and counter electrode. More specifically, the pixel electrode of each display pixel PX is divided, for example, into three sub-pixels PE1, PE2, and PE3 weighted in an area ratio of 1:2:4 shown in FIG. 4. In this case, the gradation ratio of 1:4:16 can be attained.

The liquid crystal controller 2 receives a 5-bit digital video signal and sync signal supplied, for example, from the exterior, converts the digital video signal into 3-bit PWM (pulse Width Modulation) data DATA1 and 3-bit area-dependent gradation data DATA2 and generates clock signals CLK, CL1, and CL2, vertical scanning control signal YCT and horizontal scanning control signal XCT which are synchronized with the sync signal.

The scanning line driving circuit 3 is controlled by the vertical scanning control signal YCT so as to sequentially supply a scanning signal to the scanning lines Y1 to Ym for each vertical scanning (frame) period. The signal line driving circuit 4 is controlled by the horizontal scanning control signal XCT so as to serial-parallel convert the PWM data DATA1 and supply the resultant data to the signal lines XA1 to XAn and serial-parallel convert the area-dependent gradation data DATA2 and supply the resultant data to the signal lines XB1 to XBn in each horizontal scanning period (1H) in which each scanning line Y is driven by the scanning signal.

Figure 2:
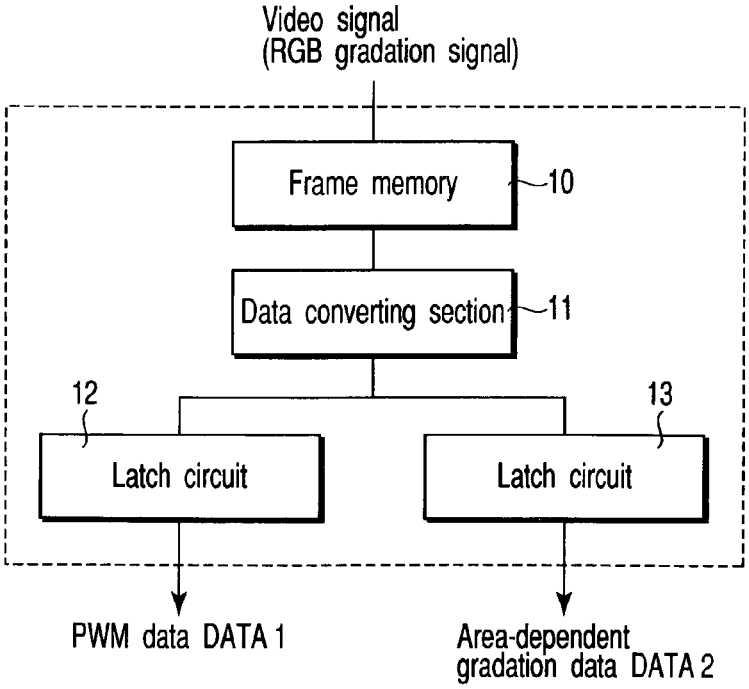
FIG. 2 is a diagram showing the configuration of a graphic control section provided in a liquid crystal controller shown in FIG. 1.

FIG. 2 shows the configuration of a graphic control section provided in the liquid crystal controller 2. The graphic control section includes a frame memory 10 which stores 5-bit video signals for one frame, a data converting section 11 which sequentially reads out the video signals stored in the frame memory 10 and converts the video signal into 3-bit PWM data DATA1 and 3-bit area-dependent gradation data DATA2, a latch circuit 12 which latches the PWM data DATA1 obtained from the data converting section 11, and a latch circuit 13 which latches the area-dependent gradation data DATA2 obtained from the data converting section 11. The 3-bit PWM data DATA1 is data which selects pulse widths weighted in a time ratio of 1:2:4, for example, with respect to driving pulses for the sub-pixels PE1, PE2, and PE3. The 3-bit area-dependent gradation data DATA2 is data which selects the sub-pixels PE1, PE2, and PE3. The number of bits of the PWM data DATA1 and area-dependent gradation data DATA2 is six in total so as to express 64 gradations greater in number than 32 gradations expressed by a 5-bit video signal. The data converting section 11 has a mapping table which assigns each video signal to a combination of the PWM data DATA1 and area-dependent gradation data DATA2 and converts the video signal into the PWM data DATA1 and area-dependent gradation data DATA2 with reference to the table. The PWM data DATA1 and area-dependent gradation data DATA2 are supplied to the signal line driving circuit 4.

Figure 3:
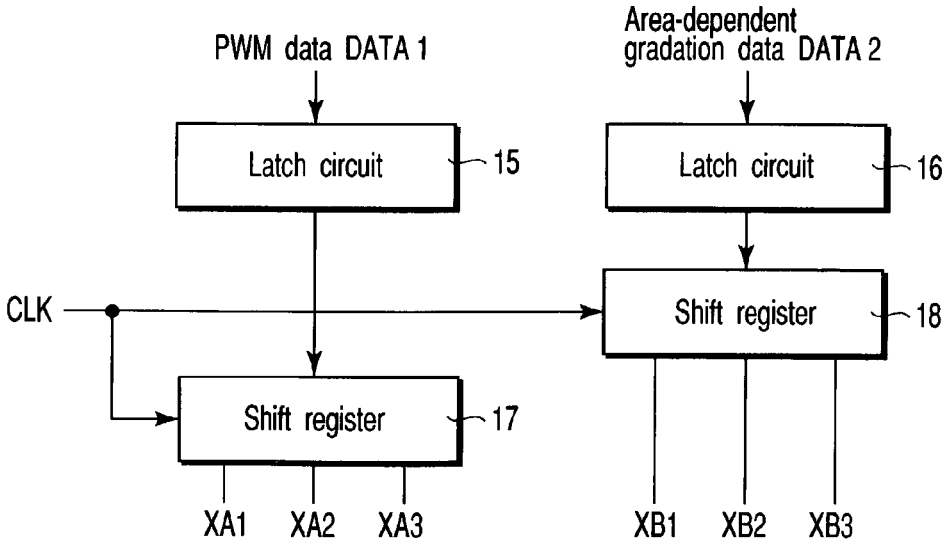
FIG. 3 is a diagram showing the configuration of a signal line driving circuit shown in FIG. 1.

FIG. 3 schematically shows the configuration of the signal line driving circuit 4. The signal line driving circuit 4 includes a latch circuit 15 which latches PWM data DATA1, a latch circuit 16 which latches area-dependent gradation data DATA2, a shift register 17 which shifts the PWM data DATA1 from the latch circuit 15 in synchronism with a clock signal CLK and assigns the same to the signal lines XA1, XA2, XA3, . . . , and a shift register 18 which shifts the area-dependent gradation data DATA2 from the latch circuit 16 in synchronism with the clock signal CLK and assigns the same to the signal lines XB1, XB2, XB3, The signal lines XA1, XA2, XA3, sequentially receive 3-bit PWM data DATA1 bit by bit from the shift register 17 and the signal lines XB1, XB2, XB3, . . . , sequentially receive 3-bit area-dependent gradation data DATA2 bit by bit from the shift register 18.

Figure 4:
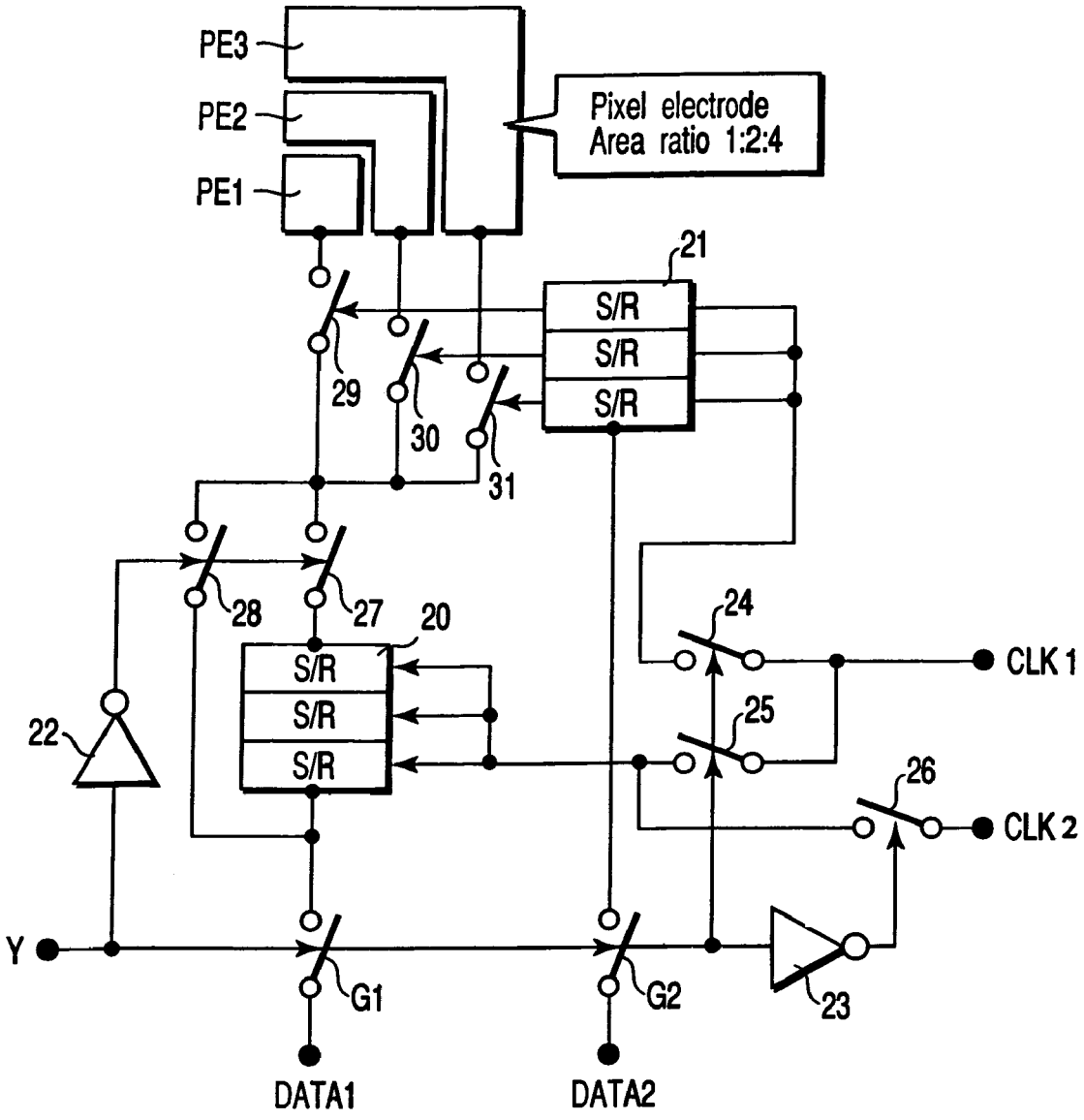
FIG. 4 is a diagram showing the configuration of a video data transfer circuit incorporated in each display pixel shown in FIG. 1.

FIG. 4 shows the configuration of a video data transfer circuit incorporated in each display pixel PX. The display pixel PX includes a shift register 20 for PWM data, a shift register 21 for area-dependent gradation data, inverters 22 and 23, and switch elements 24 to 31. The shift register 20 is connected to receive PWM data DATA1 serially supplied via the pixel switch G1, and the shift register 21 is connected to receive area-dependent gradation data DATA2 via the pixel switch G2. The switch elements 24 and 25 are connected to receive a scanning signal from the scanning line Y and supply a clock signal CLK1 to the shift registers 21 and 20 while the above scanning signal is being supplied to the scanning line Y. The switch element 26 is connected to receive a signal obtained by inverting a scanning signal from the scanning line Y by use of the inverter 23 and supply a clock signal CLK2 to the shift register 20 while the scanning signal is not being supplied to the scanning line Y. The switch elements 27 and 28 are connected to receive a signal obtained by inverting a scanning signal from the scanning line Y by use of the inverter 22. The switch element 27 outputs PWM data DATA1 from the shift register 20 while the scanning signal is not being supplied to the scanning line Y, and the switch element 28 feeds back the PWM data DATA1 output via the switch element 27 to the input terminal of the shift register 20. The sub-pixels PE1, PE2, and PE3 are connected to the switch element 27 via the respective switch elements 29, 30, and 31. The switch elements 29, 30, and 31 are controlled by the shift register 21.

Next, the operation of the video data transfer circuit in the display pixel PX is explained. One horizontal scanning period in which the scanning signal is supplied to the scanning line Y is used as a data write period during which PWM data DATA1 and area-dependent gradation data DATA2 are written into the shift registers 20 and 21 and the remaining portion of one frame period is used as a data holding period during which the sub-pixels PE1, PE2, and PE3 are driven by the PWM data DATA1 and area-dependent gradation data DATA2. In the data write period, the PWM data DATA1 and area-dependent gradation data DATA2 are serially supplied to the shift registers 20 and 21.

The shift register 20 sequentially shifts and holds the PWM data DATA1 in synchronism with the clock signal CLK1 supplied via the switch element 25 shown in FIG. 4. In the same manner as described above, the shift register 21 sequentially shifts and holds the area-dependent gradation data DATA2 in synchronism with the clock signal CLK1 supplied via the switch element 24. Since the switch elements 27 and 28 are maintained in the nonconductive state in the data write period, the sub-pixels PE1, PE2, and PE3 are not driven.

Figures 5, 6:
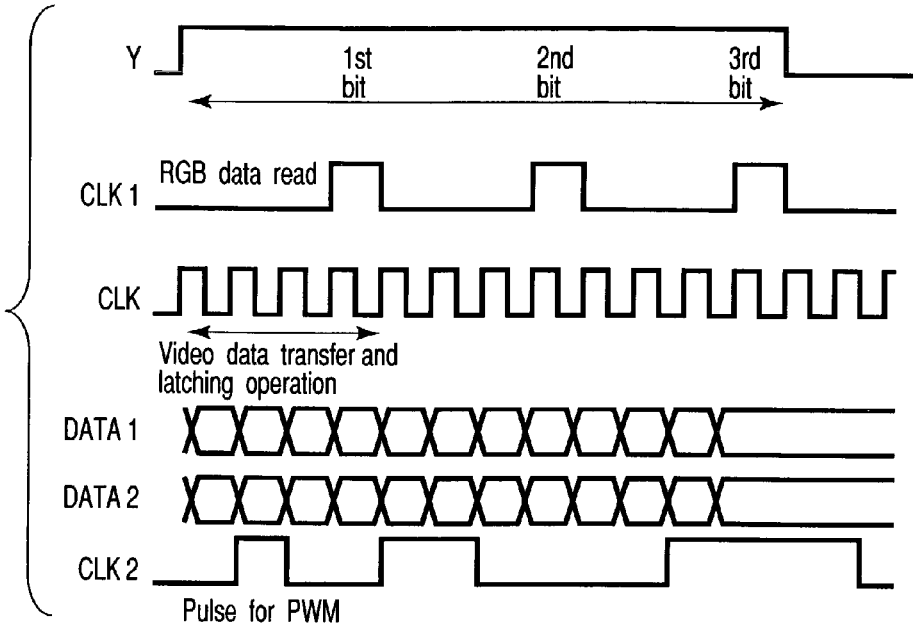
FIG. 5 is a waveform diagram for illustrating the operation of the video data transfer circuit shown in FIG. 4.
FIG. 6 is a diagram schematically showing the relation between the transmittances and combinations of PWM pulse widths and area-dependent gradations in the display pixel shown in FIG. 4.

In the data holding period following on the data write period, the switch elements 24 and 25 are set into the nonconductive state and the switch elements 26, 27, and 28 are set into the conductive state. The switch element 26 supplies to the shift register 20 the clock signal CLK2 having a pulse width ratio of 1:2:4 as shown in FIG. 5. The shift register 20 shifts the PWM data DATA1 in synchronism with the clock signal CLK2. As a result, each bit of the PWM data DATA1 is continuously output via the switch element 27 for a length of time determined by the pulse width of the clock signal CLK2 and applied to the sub-pixel PE1, PE2, or PE3 via the switch element 29, 30, or 31 which is selected by the control of the shift register 21. Further, since the switch element 28 feeds back the PWM data DATA1 to the input terminal of the shift register 20 while the pulse of the clock signal CLK2 is periodically supplied, the sub-pixels PE1, PE2, and PE3 are continuously driven.

FIG. 6 schematically shows the relation between the transmittances and combinations of PWM pulse widths and area-dependent gradations. The transmittance of each display pixel PX is determined by the product of the PWM pulse width and the area-dependent gradation. In FIG. 6, the conversion is made to set the maximum transmittance to "1". There are 64 combinations of the PWM pulse widths and area-dependent gradations, but since some gradations having the same values as shown by black dots in FIG. 6 are provided, the actual number of gradations is approximately 45. For the gradation having the same value, it is preferable to preferentially use the PWM pulse width. Further, it is impossible to use portions near the maximum and minimum gradations when taking the characteristic of the liquid crystal material into consideration. The gradations thus left behind are selected as 32 gradations expressed by a 5-bit video signal. The above mapping table holds the PWM data DATA1 and area-dependent gradation data DATA2 corresponding to the PWM pulse widths and area-dependent gradations respectively assigned to the selected gradations.

In the above liquid crystal display device, the gradation of each display pixel PX is determined by selectively combining the sub-pixels PE1, PE2, and PE3 weighted in a preset area ratio with the driving periods weighted in a preset pulse width ratio. In this case, since each display pixel PX has gradations of a number depending on the product of the number of sub-pixels and the number of driving periods, the number of sub-pixels required for attaining a desired number of gradations can be reduced. Therefore, the area of the smallest sub-pixel can be made large to remove restrictions due to the processing accuracy.

The present invention is not limited to the above embodiment and can be variously modified without departing from the scope thereof.

Figure 7:
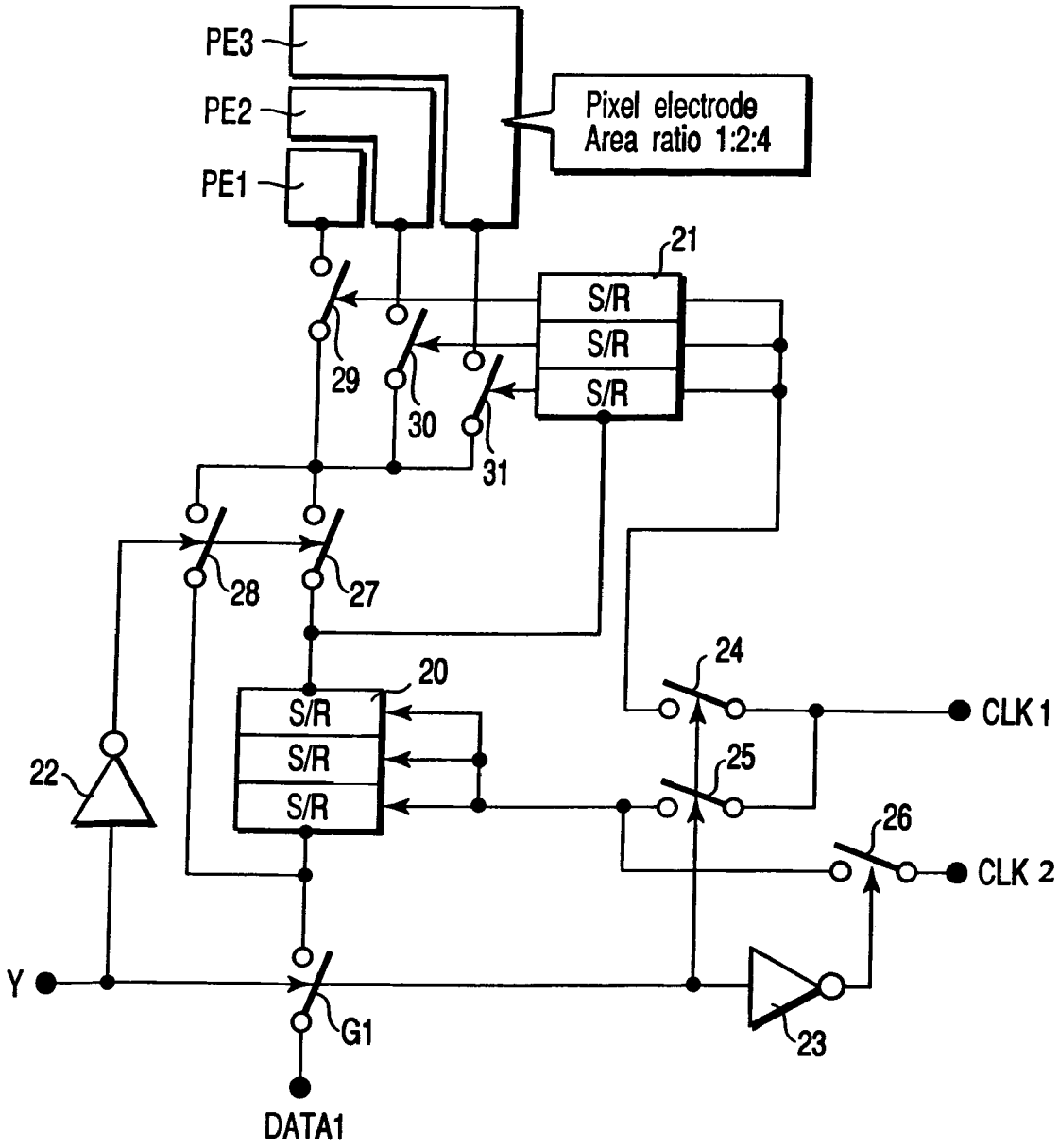
FIG. 7 is a diagram showing a modification of the video data transfer circuit shown in FIG. 4.
Figure 8:
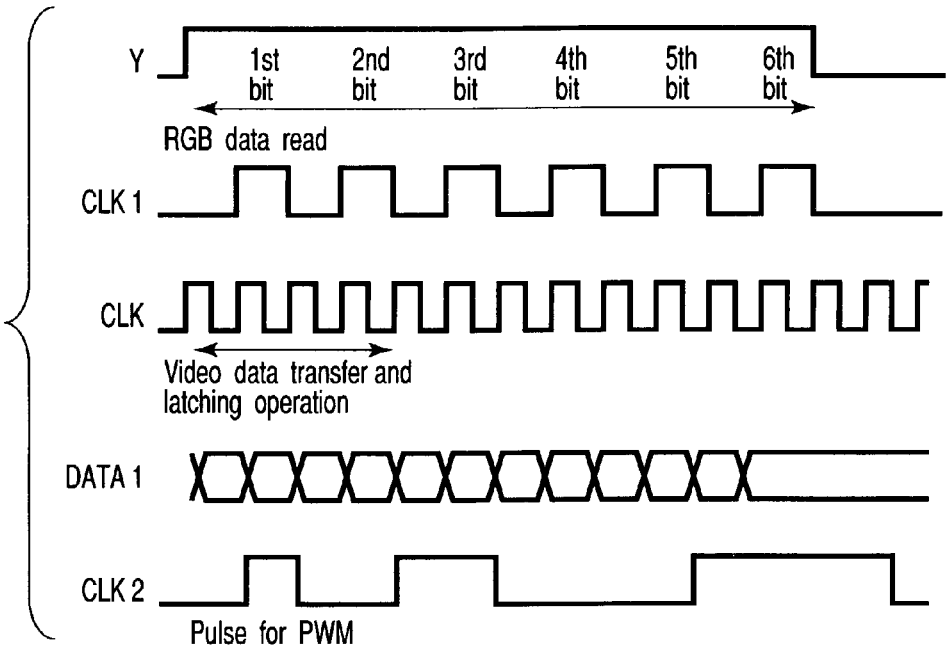
FIG. 8 is a waveform diagram for illustrating the operation of the video data transfer circuit in FIG. 7.

For example, the video data transfer circuit incorporated in each display pixel PX may be modified as shown in FIG. 7. That is, the shift register 21 is connected to receive the PWM data DATA1 supplied bit by bit from the shift register 20, instead of the area-dependent gradation data DATA2 supplied via the pixel switch G2. In this modification, the clock signal CLK1 is produced as shown in FIG. 8.

In the data write period, the PWM data DATA1 is serially supplied to the shift register 20, and data from the shift register 20 is serially supplied to the shift register 21. The shift register 20 sequentially shifts and holds the PWM data DATA1 in synchronism with the clock signal CLK1 supplied via the switch element 25. The shift register 21 sequentially shifts and holds the data from the shift register 20 in synchronism with the clock signal CLK1 supplied via the switch element 24. Since the switch elements 27 and 28 are maintained in the nonconductive state in the data write period, the sub-pixels PE1, PE2, and PE3 are not driven.

In the data holding period following on the data write period, the switch elements 24 and 25 are set into the nonconductive state and the switch elements 26, 27, and 28 are set into the conductive state. The switch element 26 supplies to the shift register 20 the clock signal CLK2 having a pulse width ratio of 1:2:4 as shown in FIG. 8. The shift register 20 shifts the PWM data DATA1 in synchronism with the clock signal CLK2. As a result, each bit of the PWM data DATA1 is continuously output via the switch element 27 for a length of time determined by the pulse width of the clock signal CLK2 and applied to the sub-pixel PE1, PE2, or PE3 via the switch element 29, 30, or 31 which is selected by the control of the shift register 21. Further, since the switch element 28 feeds back the PWM data DATA1 to the input terminal of the shift register 20 while the pulse of the clock signal CLK2 is periodically supplied, the sub-pixels PE1, PE2, and PE3 are continuously driven.

Even if the circuit configuration is simplified as described above, the gradation of each display pixel PX is also determined by selectively combining the sub-pixels PE1, PE2, and PE3 weighted in a preset area ratio with the driving periods weighted in a preset pulse width ratio. Therefore, the effects set forth in the embodiment can be obtained in this modification.

As another example, when a gamma value of the display gradation is adjusted, the ratio of pulse widths is varied.

Further, it is preferable to divide wirings used for supplying driving pulses of the pulse-width modulation into blocks in the scanning direction and signal line direction and supply the driving pulses at adequate time intervals. In this case, the supply interval is 20 kHz to 10 kHz.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat-panel display device comprising:

a plurality of display pixels each including sub-pixels weighted in a preset area ratio; and a driving circuit which drives said display pixels;

wherein said driving circuit is configured to determine the gradation of each display pixel by selectively combining the sub-pixels with driving periods weighted in a preset time ratio, said driving circuit includes a video data transfer circuit incorporated in each display pixels, and a control circuit which controls transfer of video data from the video transfer circuit to the sub-pixels, and said control circuit includes a scanning signal generating section configured to generate a scanning signal used to sequentially select the display pixels for every preset number of pixels, and said video data transfer circuit is configured to sequentially transfer the video data while the scanning signal is not being supplied.

2. The flat-panel display device according to claim 1, wherein said transfer of the video data is repeated by use of a transfer signal having pulses whose widths correspond to the driving periods.

3. The flat-panel display device according to claim 2, wherein each pulse width of the transfer signal is not shorter than that of a signal for supplying the video data to said video data transfer circuit.

4. The flat-panel display device according to claim 2, wherein each pulse width of the transfer signal corresponds to a constant multiple of a pulse width of a signal for supplying the video data to said video data transfer circuit.

5. The flat-panel display device according to claim 2, wherein said driving circuit includes a conversion circuit which converts a video signal into the video data representing one of combinations of the sub-pixels and pulse widths of the transfer signal set in a ratio identical to an area ratio of the sub-pixels to determine the gradation of each display pixel.

6. The flat-panel display device according to claim 5, wherein a gradation ratio obtained by the area ratio of the sub-pixels coincides with a constant multiple of the pulse width ratio of the transfer signal.

7. The flat-panel display device according to claim 5, wherein the pulse width ratio of the transfer signal is varied to make a gamma correction for the display gradation.

8. The flat-panel display device according to claim 2, wherein said preset number of display pixels are divided into a plurality of blocks to which the transfer signal is supplied at time intervals.

* * * * *